United States Patent [19]

Fujiwara

[11] Patent Number: 4,634,821

[45] Date of Patent: Jan. 6, 1987

[54] SWITCHING APPARATUS FOR A TIME SWITCH

[75] Inventor: Ichiro Fujiwara, Hiroshima, Japan

[73] Assignee: Mitsubishi Denki Kabushiki Kaisha, Japan

[21] Appl. No.: 743,839

[22] Filed: Jun. 12, 1985

[30] Foreign Application Priority Data

| | | | |
|---|---|---|---|
| Jun. 12, 1984 | [JP] | Japan | 59-122481 |
| Jun. 12, 1984 | [JP] | Japan | 59-122483 |
| Jun. 12, 1984 | [JP] | Japan | 59-122484 |
| Jun. 12, 1984 | [JP] | Japan | 59-122485 |

[51] Int. Cl.[4] ..... H01H 43/06

[52] U.S. Cl. ..... 200/38 FB; 200/38 DB

[58] Field of Search ..... 200/38 R, 38 A, 38 F, 200/38 FA, 38 FB, 38 B, 38 BA, 38 C, 38 CA, 38 D, 38 DA, 38 DB, 38 DC

[56] References Cited

U.S. PATENT DOCUMENTS 2,596,330 5/1952 Everard ..... 200/38 DB

*Primary Examiner*—A. D. Pellinen
*Assistant Examiner*—Morris Ginsburg
*Attorney, Agent, or Firm*—Sughrue, Mion, Zinn, Macpeak, and Seas

[57] ABSTRACT

A time switch having two scale disks rotating at different speeds. A program, set by projections, on the faster disk can be cancelled by like projections on the slower disk. Levers contact the respective disks and, directly or indirectly, contact on one side a common lever that actuates the plunger of a switch. Additional manual means are provided for positively actuating or deactuating the switch, by holding some of the levers at fixed positions.

8 Claims, 20 Drawing Figures

SWITCHING APPARATUS FOR A TIME SWITCH

BACKGROUND

The present invention relates to an improvement for a time switch capable of automatically setting, or selecting, the execution or the cancellation of a predetermined switching program operating with, for example, a 24 hour period and a weekly period. The improvement provides a more efficient design and a further manual interruption.

A conventional time switch is shown in FIG. 1. In FIG. 1, a 24 hour scale disk 1 is driven by a synchronous electric motor (not shown) to rotate one revolution for each 24 hour period.

A setter 2 is fixed at a position on the peripheral portion of the 24 hour scale disk 1. More than one setter 2 may be provided. The position is selected to correspond to a desired time by using suitable means such as a screw or the like. As time passes, the 24 hour scale disk 1 rotates, and a switch 3 is opened or closed at a desired time dependent upon the time-varying contact and loss of contact between the setter 2 and a mechanism such as a switch lever. Another scale disk 4 is used to measure the days in a week and is driven similarly to the 24 hour scale disk 1 except that it rotates one revolution during one week. The week scale disk 4 is rotationally positioned in a predetermined relationship with respect to a time position of the 24 hour scale disk 1.

A rotary switch 5 sequentially steps from one position to the next for each 24 hour from Sunday to Saturday to thereby advance seven steps for one week. This stepping is accomplished by the rotation of the week scale disk 4 through a suitable mechanism such as a train of cam wheels (not shown). The common terminal of the rotary switch 5 is connected to a power source 8. A single-pole triple-throw selecting switch 6 selects the execution or the cancellation of the daily program set on the 24 hour scale disk 1, according to each desired day of the week. There are a total of seven selecting switches 6 respectively corresponding to the days from Sunday to Saturday. Each selecting switch 6 can be set at one of three conditions. Namely the first condition is automatic or "AUTO" and its terminal is connected in series with the switch 3. The second condition is off or "OFF" and its terminal is opened or not connected. The third condition is "ON" and its terminal is connected in parallel with the switch 3 regardless of the program on the 24 hour scale disk 1.

The common terminal of each selecting switch 6 is connected in series to the respective contacts of the corresponding day in the rotary switch 5.

Referring to the operation of the switching apparatus, FIG. 1 shows the contact of the rotary switch 5 positioned at the Tuesday position, that is, the present time is Tuesday, and the selecting switch 6 for Tuesday is set at the condition of "AUTO".

In this condition, the rotary switch 5 has already been connected to the selecting switch 6, so that a load 7 is directly controlled by the switching operation of the switch 3. Namely the switching operation of the switch 3 is effected in accordance with the program set by the placement of the setter 2 on the 24 hour scale disk 1. In this condition, if the switch 3 is closed (namely, the load 7 is powered), the selecting switch 6 can be manually switched to "OFF" in order to unpower the load 7 for any necessary and temporary unpowered interruption. Further in the case where the switch 3 is open (namely the load 7 is unpowered), the selecting switch 6 can be manually switched to "ON" in order to power the load 7 for any necessary and temporary powered interruption. The above mentioned operation is for the example of Tuesday, and a similar operation as the above is of course made for other days of the week in accordance with the position of the rotary time switch 5.

According to the time switch thus constructed, it is possible to decide whether the program with the 24 hour period should be executed or cancelled each desired day of the week, by initially selecting either of the three conditions (i.e., "AUTO", "ON" or "OFF") of the selecting switch 6 corresponding to each day of the week. Further it is possible to control the selecting switches 6 independently and with priority from the contents of a program for any interrupting operation, by operating the selecting switch of the desired day of the week. Therefore it is easy to control devices which are not operated on holidays, and it is very convenient to check and maintain the load 7 such as radio receiver without stopping the entire time switch.

However, the conventional time switching apparatus, as shown in FIG. 1, has the following disadvantages. First, it is necessary to provide not only the switch 3 but also the rotary switch 5 and the selecting switch 6, especially since seven selecting switches 6 corresponding to respective days of the week are necessary. As a result, the number of parts required in its manufacture are increased and the fabrication thereof and the adjusting operation are complex. Of course, as a result, its cost is increased. Secondly, usually the rotary switch 5 is located internally in the time switch and should have a general switching capacity. However, physical constraints typically limit its switching capability to much less than the switching capacity of the switch 3 and the selecting switch 6 which are constructed as described. Therefore the switching capacity of the entire time switch is determined primarily by the switching capacity of the rotary switch 5 having the smallest switching capacity. As a result, the switching capacity of the time switch is unavoidably reduced. Thirdly, even if the load 7 is powered or unpowered independently of the predetermined program by the temporary interrupting operation effected by the manual operation of the proper selecting switch 6 according to the day of the week, if the day changes in the course of time (namely the week scale disk 4 is rotated by one revolution, such as from Tuesday to Wednesday) in the middle of the interrupt operation, the rotary switch 5 is therefore stepped to the next day of the week. In this case, the state of the load 7 is determined in accordance with the condition of the selecting switch 6 of the next day of the week rather than the interrupting condition set in the selecting switch 6 on the preceding day. That is, there is a problem that the contents of a desired interrupting operation is not necessarily executed sequentially unless not only the selecting switch 6 of the corresponding day but also the selecting switch 6 of the next day are initially set.

SUMMARY OF THE INVENTION

An object of the present invention is to remove the abovementioned disadvantages.

A further object is to provide, within a switching apparatus of a time switch, a selecting/setting function for automatically selecting for a long predetermined period the execution or the cancellation of a switching program operating with a shorter predetermined period.

It is a further object to provide within the switching apparatus an interrupt operating function by which the selected condition can be changed to a different condition temporarily, and the day of the week can be changed without any special means, so that the interrupting operation initiated before the change of day is sure to be executed even after the change of day.

It is yet a further object to reduce the number of switching elements to only one in comparison with the conventional apparatus requiring a plurality of switching elements.

Yet another object is to facilitate the fabrication and adjustment of the switching apparatus and reduce the cost of its fabrication without decreasing its switching capacity.

The invention can be summarized as a switching apparatus for a time switch in which one scale disk contains a program for a shorter length of time, such as a 24 hour period. Another scale disk for a longer length of time, such as a week, can cancel the program of the first scale disk. Lever arms follow the separate scale disks and selectively contact, directly or indirectly, a common lever selectively activating a spring loaded plunger on a switch such that either lever arm can move the common lever in a first direction but both lever arms need to be in agreement to move the common lever in the other direction. Furthermore, manual interrupting means can defeat the programs on the two scale disks to positively depress or raise the plunger.

DETAILED DESCRIPTION OF THE PREFERRED EMBODIMENTS

Figure 1:
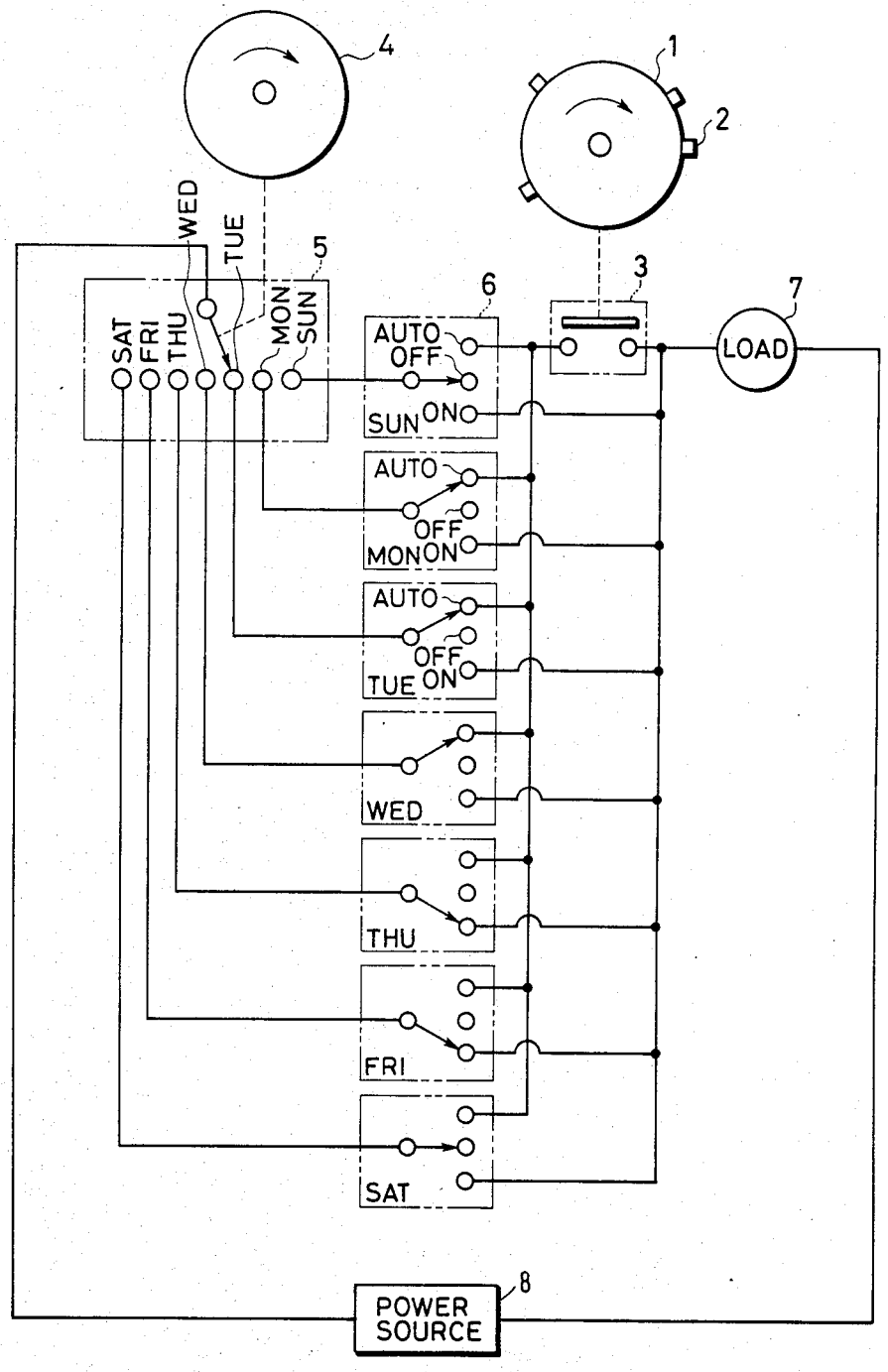
FIG. 1 PRIOR ART
FIG. 1 is a block diagram illustrating a conventional time switch.

An embodiment of the present invention will be explained with reference to FIG. 2. A 24 hour scale disk 11 and a week scale disk 12 are mounted rotatably on shafts 13 and 14 respectively that are fixed on a support (not shown). Hour and day setters 15 and 16 are mounted on the peripheral portions of the 24 hour scale disk 11 and the week scale disk 12 respectively, and rotated together with the scale disks 11 and 12. By the provision of the hour setter 15 on the 24 hour scale disk 11, a switch 31 is closed in accordance with the time corresponding to the position of the setter 15.

On the other hand, by the provision of the day setter 16 on the week scale disk 12, the program set on the 24 hour scale disk 11 of the corresponding day is cancelled. That is, the day setter 16 is not provided at the position on the week scale disk 12 corresponding to the day at which a certain program on the 24 hour scale disk 11 is required to be executed.

Switching levers 17 and 18, one end of each of which is provided opposite to each of the scale disks 11 and 12, are rotatable around a fixed axis 19 in a contacting relation with the setters 15 and 16. The fixed axis 19 also rotatably supports intermediate levers 20 and 21. Thus the switching levers 17 and 18 and the intermediate levers 20 and 21 are supported by the fixed axis 19, and the support is separate so that they can be rotated independently of each other. Springs 22 and 23 or interlocking means are disposed between a respective projection 17*a* or 18*a* at the end of the switching lever 17 or 18, and a projection 20*a* or 21*a* of the intermediate levers 20 or 21. Moreover stoppers 17*b* and 18*b* on the switching levers 17 and 18 engage corresponding stoppers 20*b* and 21*b* on the intermediate levers 20 and 21, so that the switching lever 17 or 18 cannot rotate with respect to the corresponding intermediate lever 20 or 21 in the compressed direction of the springs 22 and 23 to thereby maintain a constant minimum angle.

An auxiliary lever 26 is rotatably mounted on a fixed axis 27. The position of the upper surface of the auxiliary lever 26 is adjusted opposite to the other ends of the intermediate levers 20 and 21 through adjusting screws 28 and 29 on the intermediate levers 20 and 21. The lower surface of the auxiliary lever 26 is arranged opposite a plunger 31*a* of the switch 31 with normally opened contacts, that is, normally off. The plunger 31*a* is forced upwardly, i.e. in the direction in which the contacts of the switch 31 are opened, with a small force by using suitable means such as a spring (not shown) mounted within the switch 31. Therefore the other ends of the intermediate levers 20 and 21 are pushed up through the auxiliary lever 26. The adjusting screws 28 and 29 are used for delicately adjusting the inward operation position of the switch 31.

As mentioned above, the switching levers 17 and 18 are respectively pushed upwardly from the disks 11 and 12 by the setters 15 and 16 thereby rotate about the axis 19 in the direction indicated by the arrows A. Then the intermediate levers 20 and 21 are respectively rotated by the force of the springs 22 and 23 so that the other ends of one or both of the intermediate levers 20 and 21 push the auxiliary lever 26 down, thereby pushing in the plunger 31*a* of the switch 31.

Furthermore, the switch 31 can be manually activated and interrupted by the operation of projections 33*a*, 33*b*, 33*c* and 33*d* located on the periphery of a manual lever 33. The projections 33*a*–33*d* push the other ends of the switching levers 17 and 18 and the intermediate levers 20 and 21 when the manual lever 33 is rotated.

The above operation will be explained with reference to FIGS. 3–5. For the sake of simplicity, only a switching mechanism including the switch 31 interlocked with the week scale disk 12 is shown in FIGS. 3–5.

Figure 3:
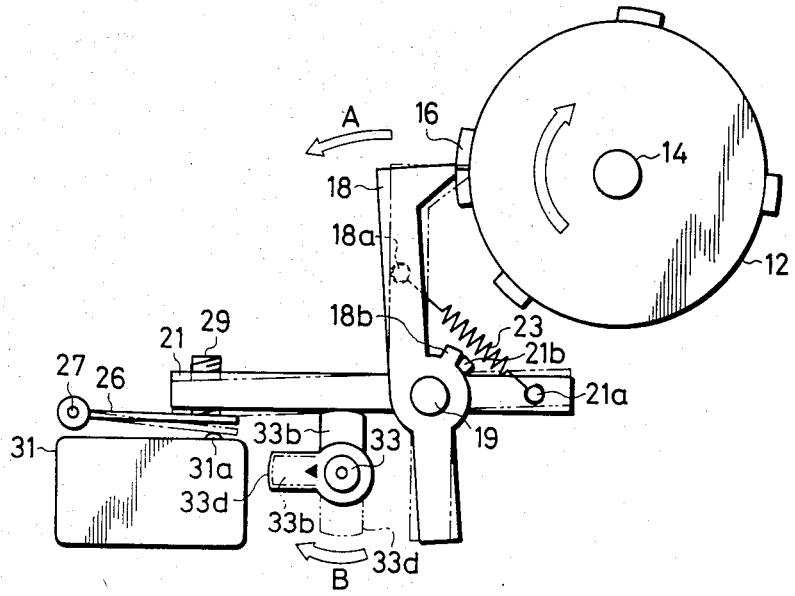
FIGS. 3–5 are side views showing respectively the selection of the OFF, ON and AUTOMATIC operation of the embodiment of FIG. 2.

Referring to FIG. 3, the manual lever 33 is rotated to the OFF position in the direction by the arrow B. At this time, the projection 33*b* is rotated from the position indicated by a dotted line to the position indicated by the solid line in the clockwise direction of the arrow B thereby removing the other end of the intermediate lever 21 from the plunger 31*a*. Therefore, even if the switching lever 18 is rotated counter-clockwise in the direction A by the setter 16 from the position of the dotted line to the position of the solid line, nonetheless, the spring 23 merely expands and the intermediate lever 21 is not rotated. As a result, the plunger 31*a* of the switch 31 is not pushed down.

This means that when the manual lever 33 is rotated clockwise in the direction B for temporary manual interruption, that is, for the purpose of opening the contacts of the switch 31, midway through the predetermined program operation of the time switch, the switch 31 can be opened regardless of the contents of the predetermined program.

Figure 4:
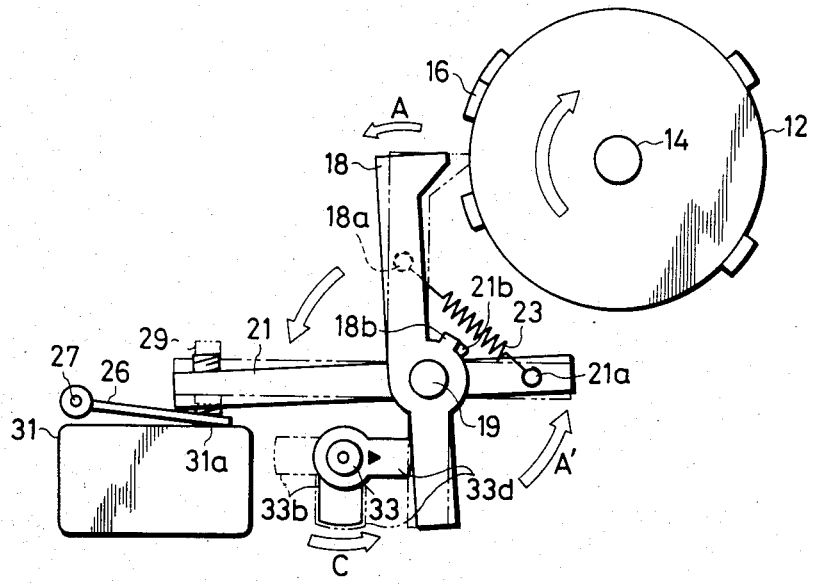
Figure 5:
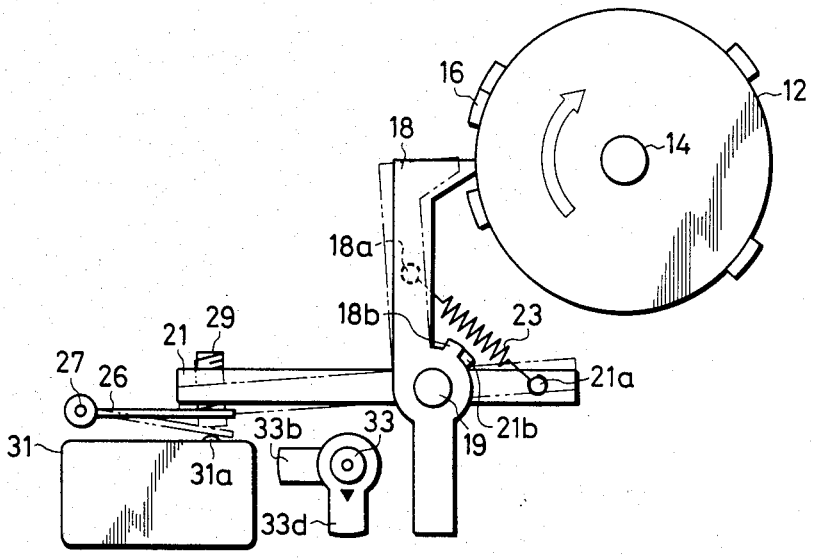

In FIG. 4, the manual lever 33 is rotated counter-clockwise in the direction of C to the ON position. The projection 33*d* pushes the other end of the switch lever 18 thereby rotating the switching lever 18 counter-clockwise in the direction of A'. As a result, the intermediate lever 21 also rotates counter-clockwise under the force of the spring 23, so that the plunger 31*a* of the switch 31 is pushed via the auxiliary lever 26. Therefore the plunger 31*a* of the switch 31 is depressed regardless of the fact that the setter 16 is contacting or detached from the switching lever 18.

This means that the manual lever 33 is rotated counter-clockwise in the direction of C for temporary manual interruption operation, for the purpose of closing the contacts of the switch 31, midway through the predetermined program operation of the time switch. Therefore, the switch 31 can be closed regardless of the predetermined program. As mentioned above, for the sake of simplicity, only the manual interruption of the program on the week scale disk 12 is explained in FIGS. 3–5. However, it should be noted that the manual interrupt operation, similar to the above manual interrupt operation of the week scale disk 12, is simultaneously performed against the program on the 24 hour scale disk 11.

Referring to FIG. 5, the manual lever 33 is shown rotated to the AUTO position. In FIG. 5, the projections 33*b* and 33*d* are not involved in the rotating of the switching lever 18 and the intermediate lever 21. Therefore in this condition, the switch 31 effects its switching operation automatically in accordance with the program dictated by the multiple setters 16 on the week scale disk 12.

According to the above arrangement of the switching apparatus, the manual lever 33, the switches 17 and 18 and the intermediate levers 20 and 21 are used together so that it is possible by using only one switch 31 to initially select the execution or the cancellation of the program for each desired day of the week, and to further independently temporarily manually interrupt the operation of the set program.

Further, since no switching element such as the rotary switch is used, the switching capacity of the time switch is determined usually by only the switch 31. Therefore, the reduction of the switching capacity dictated by a rotary switch, as mentioned in the conventional time switch, does not occur. As shown in FIGS. 3 and 4, if the manual lever 33 is set in the condition "ON" or "OFF", the switch 31 operates according to this set condition regardless of the setting contents of the setters 15 and 16. As a result, the invention avoids the disadvantage of the conventional apparatus that the interrupting operation is changed at a change of day (by the rotation of the week scale disk 17 of the present invention). According to the present invention, the interrupting operation is maintained without utilizing any special operation.

In the above embodiment, the 24 hour scale disk and the week scale disk are used as first and second scale disks. However, any scale disk with other periods (such as 60 minutes or one month) may be used to achieve the same advantages of the present invention.

Figure 6:
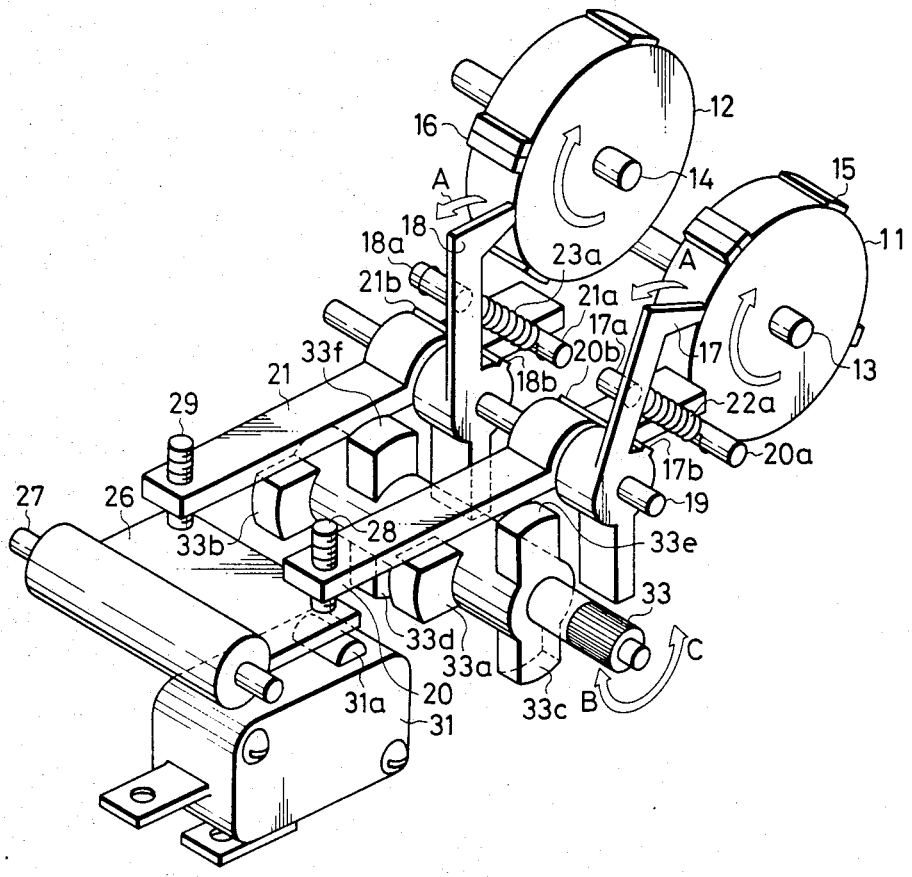
FIG. 6 is a perspective view of a second embodiment of the invention.

Another embodiment of the time switch of the present invention is shown in perspective in FIG. 6. This embodiment has many similarities to the embodiment shown in FIG. 2 so that like elements performing like functions are labelled with the same reference numerals. Instead of tension springs 22 and 23 applying force between the switching levers 17 and 18 on one hand and the intermediate levers 20 and 21 on the other hand, the embodiment of FIG. 6 uses torque springs 22*a* and 23*a* mounted on rods 20*a* and 21*a* parallel to the axis 19.

Furthermore, the projections 33*c* and 33*d*, used for contacting the lower ends of the switching levers 17 and 18 have corresponding and oppositely arranged projections 33*e* and 33*f* on the manual lever 33.

Figure 7:
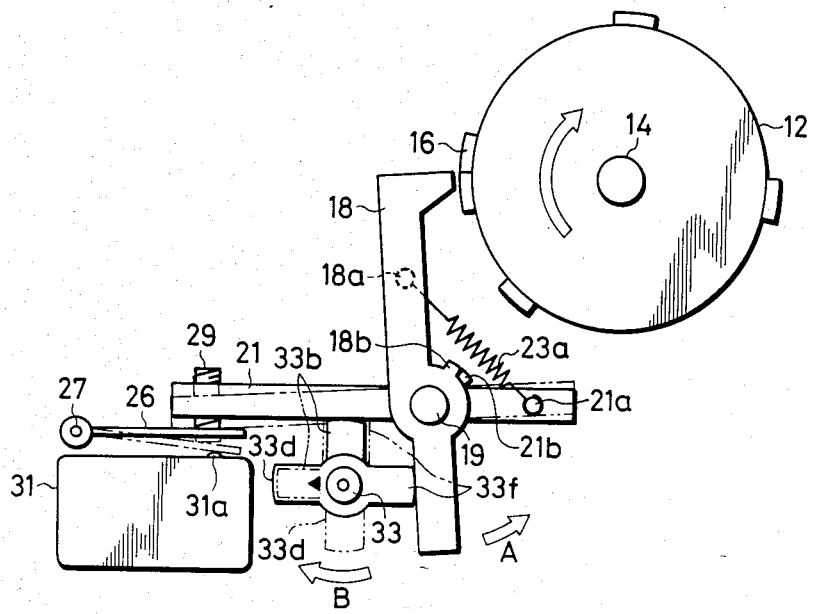
FIGS. 7–9 are side views showing the operation of the embodiment of FIG. 6.
Figure 8:
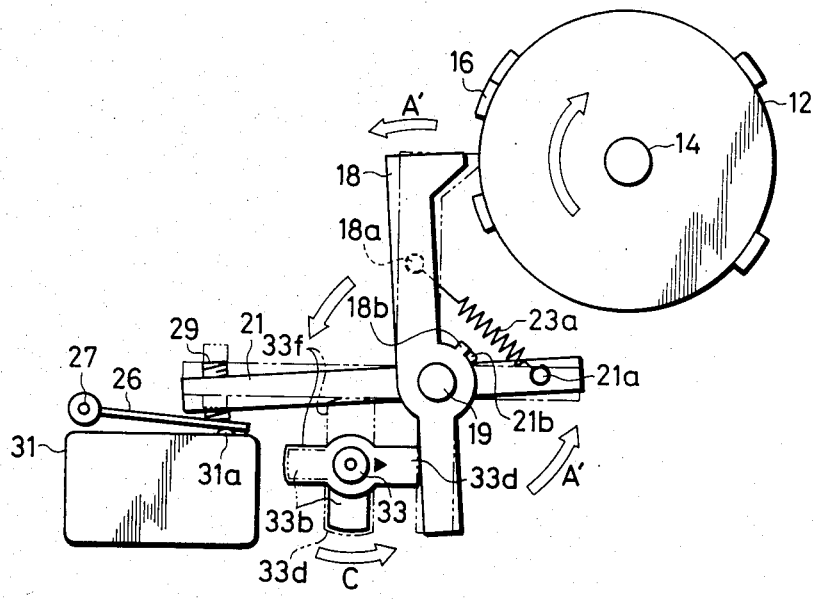
Figure 9:
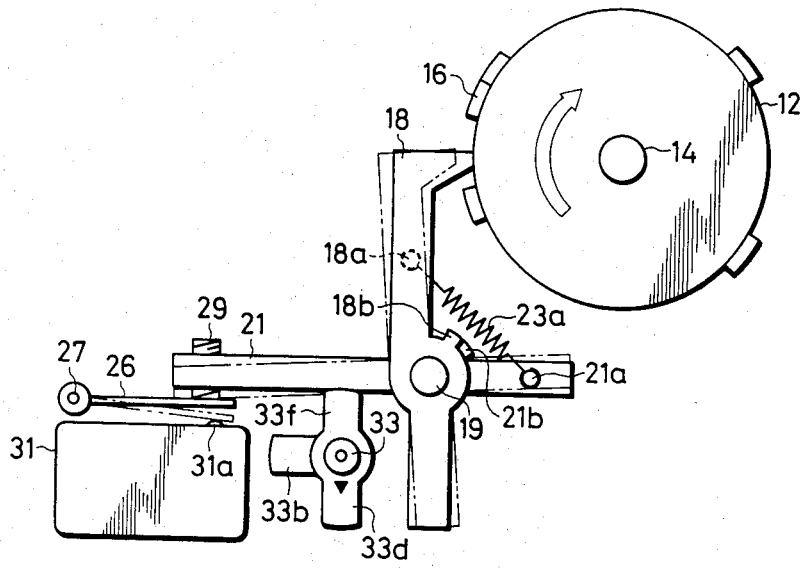

The operation of the embodiment of FIG. 6 is shown in FIGS. 7–9. For the sake of simplicity only the switch 31 and the part of the switching mechanism interlocked with the week scale disk 12 is shown.

Referring to FIG. 7, the manual lever 33 is rotated in the clockwise direction indicated by the arrow B to the OFF position. At the end of the rotation, the projections 33*b* and 33*f* are rotated from the positions indicated by dotted lines to the positions indicated by the solid lines. Thereby, the left end of the intermediate lever 21 is raised from the plunger 31*a* by the projection 33*b*. Furthermore, the switching lever 18 is rotated clockwise in the direction of the arrow B by the projection 33*f* thereby raising the switching lever 18 from the setter 16. Therefore, the intermediate lever 21 cannot push the plunger 31*a* through the auxiliary lever 26 and the switch 31 is thereby maintained in the open condition.

By means of the described structure, the lever 33 is manually rotated clockwise in the direction B for temporary manual unpowered interruption. Therefore, the contacts of the switch 31 are opened midway through the predetermined program operation of the time switch. The switch 31 can thereby be opened regardless of the contents of the predetermined program.

Figure 2:
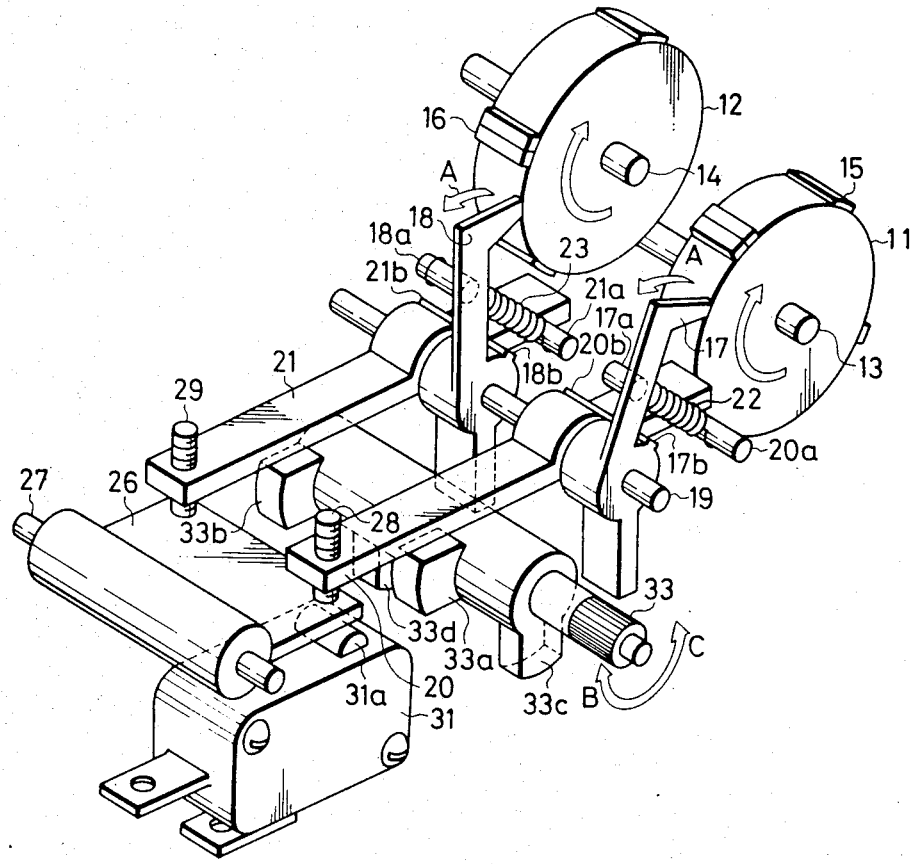
FIG. 2 is a perspective view of a first embodiment of a time switch of the present invention.

The advantage of the embodiment of FIG. 6 over the embodiment of FIG. 2 is as follows. If the left end of the intermediate lever 21 is merely raised from the plunger 31*a* by the operation of the projection 33*b*, the upper end of the switching lever 18 is pressed against the scale disk 12 by the spring action of the spring 23*a* during the OFF setting of the manual lever 33. As a result, the upper end of the switching lever 18 repeatedly engages and separates from the setter 16 with the result that excessive torque is required for the rotation of the scale disk 12. In order to avoid the above problem, the opposing projection 33*f* raises the upper end of the switching lever 18 from the setter 16 so that the setter 16 can clear the switching lever 18. Therefore, it is possible to rotate the scale disk 12 with a small rotational torque.

The ON operation is illustrated in FIG. 8. When the manual lever 33 is rotated counter-clockwise in the direction of the arrow C, the projection 33*d* pushes the lower end of the switch lever 18, thereby rotating the switch lever 18 in the counter-clockwise direction of the arrow A'. As a result, the intermediate lever 21 also rotates under the force of the spring 23*a* so that the plunger 31*a* of the switch 31 is pushed down via the auxiliary lever 26. Therefore, the plunger 31*a* of the switch 31 is depressed regardless of whether the setter 16 is intended to contact the switching lever 18 or not. This means that the manual lever 33 can be rotated in the direction of the arrow C for a temporary and manual powered interruption so as to close the contacts of the switch 31 midway through the predetermined program operation of the time switch. The switch 31 is thereby closed regardless of the contents of the predetermined time program.

In FIG. 9, the manual lever 33 is manually rotated to the AUTO position. For this operation, the projections 33*b*, 33*d* and 33*f* are not involved in the rotating operation of the switching lever 18 and the intermediate lever 21. It should be noted that the projection 33*f* is not located in the same position as the intermediate lever 21. As a result, in this state, the switch 31 performs its switching operation automatically according to the program set by the setters 16, that is, on the basis of the operation of multiple members attached to the periphery of the week scale disk 12.

It is of course to be understood that a similar operation is effected with the 24 hour scale disk 11, the switching lever 17 and the intermediate lever 20. This operation is performed simultaneously with the operation on the week scale disk 12.

As mentioned previously, the advantage of the second embodiment is that in the "OFF" state, the switching levers 17 and 18 are detached from and raised above the setters 15 and 16 so that the scale disks 11 and 12, together with the setters 15 and 16 can be rotated with a small rotational torque. As a result, the load on the scale disk motor (not shown) connected to shafts 13 and 14 is reduced and the life of the motor can be expected to be longer.

Two more embodiments will be described. These two further embodiments are very similar to each other and have some similarities to the embodiments of FIGS. 2 and 6. Therefore, common elements will be referenced by the same reference numerals and will not be described in detail.

Figure 10:
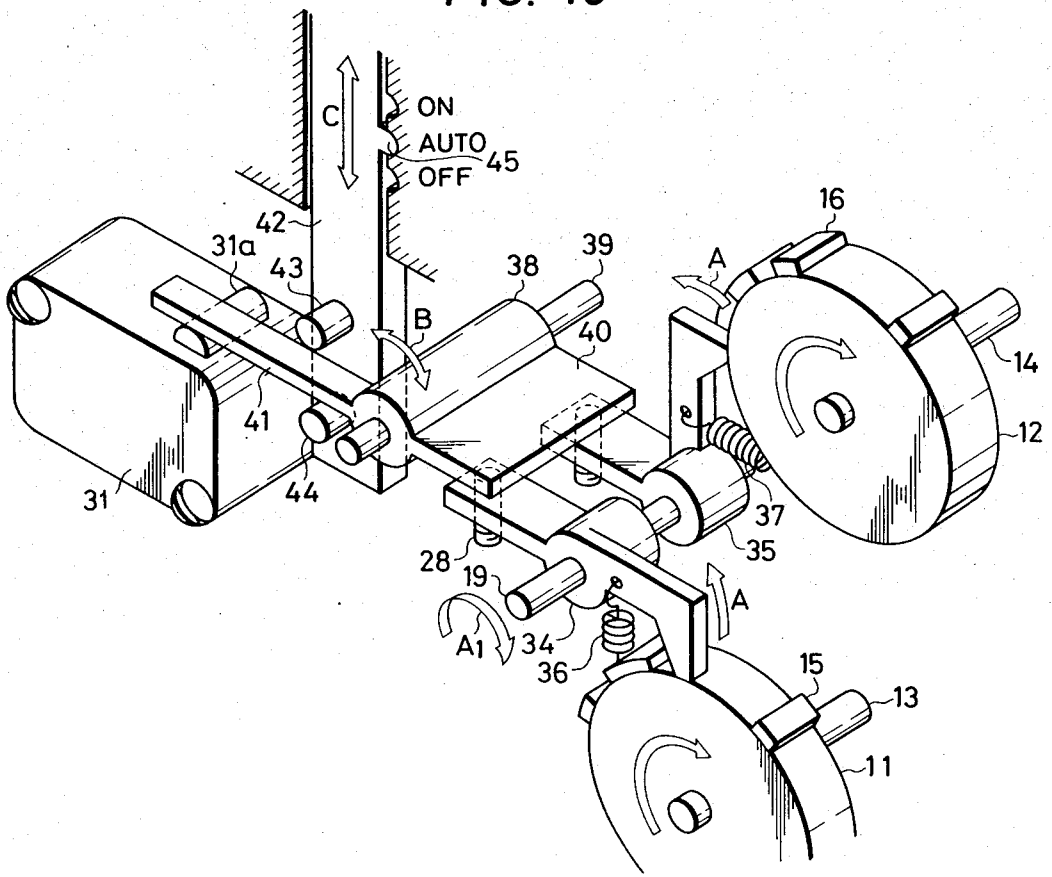
FIG. 10 is a perspective view of a third embodiment of the invention.

The third embodiment is shown in perspective view in FIG. 10. The 24 hour scale disk 11 and the week scale disk 12 are similar to those of the previously described embodiments together with the setters 15 and 16 attached to their peripheries. The switch 31 is again a normally open switch, such as a micro-switch, which is fixed to the support by screws. A 24 hour switching lever 34 and a week switching lever 35 are rotatably mounted on the fixed axis 19. The switching levers 34 and 35 are so positioned relative to the scale disks 11 and 12 that they are rotated counter-clockwise in the direction of the arrows A when the respective switching lever 34 or 35 contacts the setter 15 or 16 integrally rotating with the scale disk 11 or 12. Springs 36 and 37 respectively are engaged to the 24 hour switching lever 34 and the week scale lever 35 to force the respective switching lever 34 or 35 toward its scale disks 11 or 12. The spring force of springs 36 and 37 is set to be large enough to depress the plunger 31*a* of the switch 31, taking into account the intermediate levers. The other end of each of the springs 36 and 37 is fixed to the support.

An intermediate lever 38 is rotatably mounted on a fixed axis 39 to rotate in the two directions of arrow B. The intermediate lever 38 includes a first lever portion 40 associated with the switching levers 34 and 35 and a second lever portion 41 associated with the switch 31. The two adjusting screws 28 and 29 are threaded through ends of the switching levers 34 and 35 so as to engage the first lever portion 40. The adjusting screws 28 and 29 are used for fine adjustment of the depressed position of the plunger 31*a*. The second lever portion 41 is positioned with the aid of the adjusting screws 28 and 29 against the plunger 31*a*.

A manual lever 42 has an upper projection 43 and a lower projection 44 between which the second lever portion can pass. The manual lever is slidably mounted in the support so as to be movable in the two directions of the arrow C. It can be selectively positioned at three positions by utilizing the combination of a position projection 45 and three indentations ON, AUTO and OFF in the support which engage the position projection 45.

Figure 11:
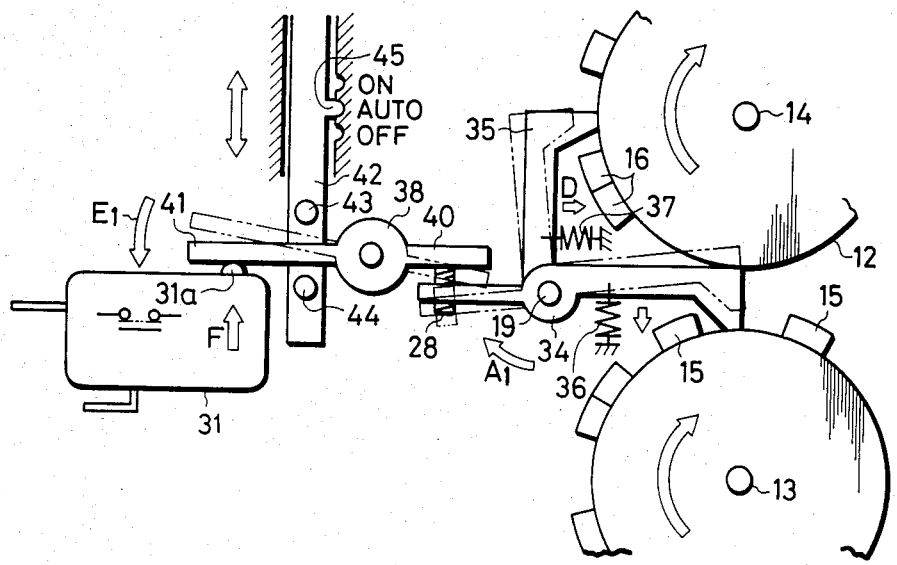
FIGS. 11–15 are side views showing the operation of the embodiment of FIG. 10.
Figure 12:
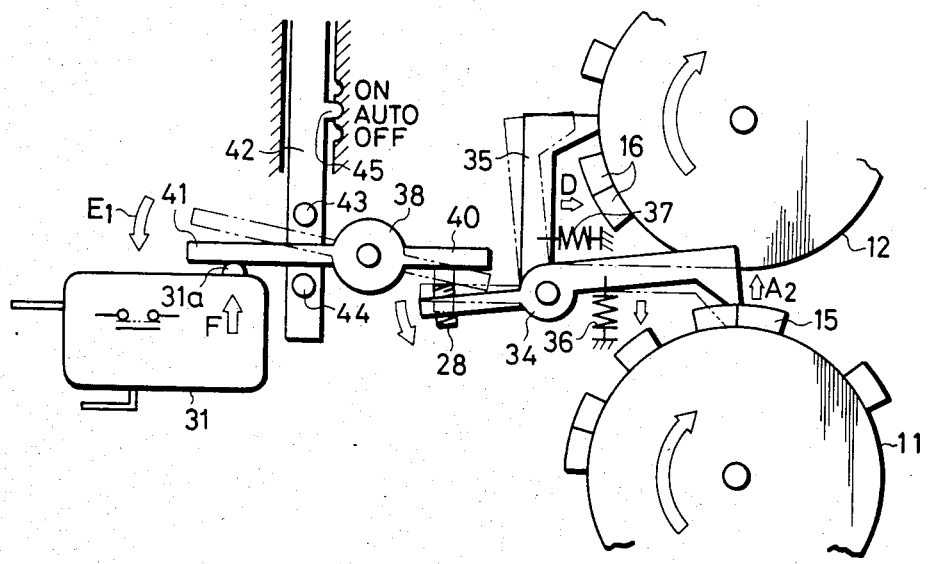
Figure 13:
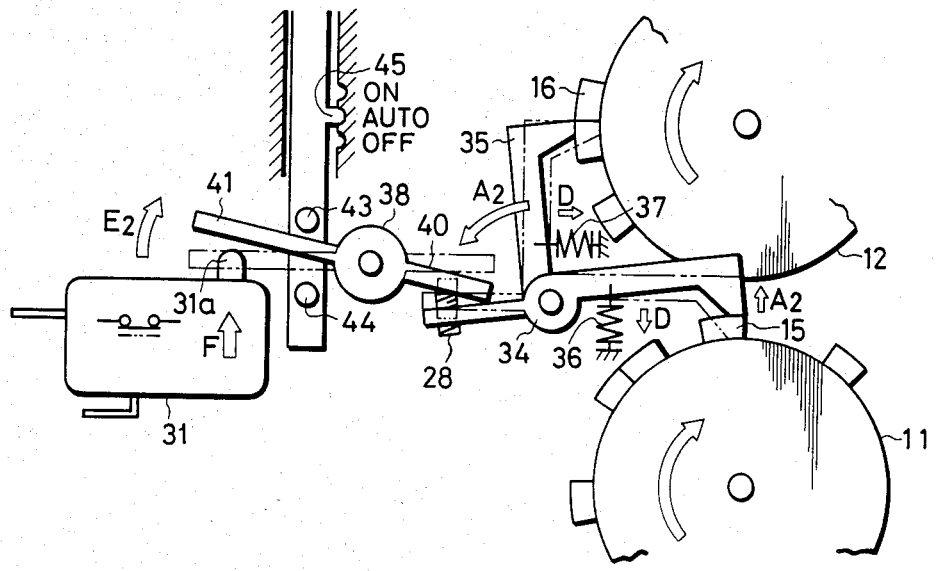

The operation of the embodiment of FIG. 10 will now be described with reference to FIGS. 11–15. FIGS. 11 and 12 show in solid lines the switching lever 35 not contacting the setters 16 while FIGS. 13 and 14 with solid lines show the switching lever 35 rotated away from the week scale disc 12 by its engagement with the setter 16. The automatic mode is set by sliding the manual lever 42 to engage the AUTO indentation, as shown in FIGS. 11–13. The week switching lever 35 is pulled in the clockwise direction of the arrow D by the tension spring 37 so as to rotate the switching lever 11 in the clockwise direction of the arrow A1. As a result, the intermediate lever 38 contacting the adjusting screw 29 (not shown in FIGS. 11–13, but shown in FIG. 10) in the week switching lever 35 rotates in the counter-clockwise direction of the arrow E1 and this condition is maintained.

If, as shown in FIGS. 11 and 12, the week switching lever 35 is not engaged with the setter 16, then the plunger 31*a* is depressed by the tensile force of the spring 37 through the levers 35 and 40. This tensile force overcomes the return force due to a return spring (not shown) in the switch 31 acting in the upward direction of the arrow F. In this state, the switch 31 is held in the open or OFF condition. The open condition of the switch 31 is maintained by the non-engagement by the week switching lever 35 with the setters 16 regardless of whether the 24 hour switching lever 34 is contacting the setter 15 on the 24 hour scale disk 11, as shown by the solid line in FIG. 12 or not contacting the setter 15 as shown by the solid line in FIG. 11. As a result, the absence of a setter 16 on the week scale disk 12 has the effect of cancelling the 24 hour program on the 24 hour scale disk when the manual lever 45 is in the AUTO position.

On the other hand, FIG. 13 shows a condition when the week switching lever 35 contacts the setter 16 on the week scale disk 12 as the disk 12 is rotated. As a result, the week switching lever 35 is rotated in the counter-clockwise direction of the arrow A2 against the opposing spring force of the tension spring 37 producing a force in the clockwise direction of the arrows D. In this position of the week switching lever 35, the 24 hour program is executed. That is, the switch 31 is controlled in its ON or OFF state according to the setters 15 on the 24 hour scale disk 11 as they operate through the 24 hour switching lever 34 and the intermediate lever 38. Briefly, if the 24 hour switching lever 34 is pushed up by the setter 15 in the direction of the arrow A2, as shown in FIG. 13, the intermediate lever 38 is rotated counter-clockwise in the direction of the arrow E2 by the return spring in the switch 31. That is, the plunger 31*a* is free to return to its normally OFF or extended position.

On the other hand, when the 24 hour switching lever 34 does not contact the setter 15 as shown by the dotted lines, the 24 hour switching lever 34 is pulled by the tension spring 36 acting in the clockwise direction D, so that the intermediate lever 38 is rotated in the counter-clockwise direction of arrow E1 (FIG. 11). Accordingly, the plunger 31*a* is depressed to close the switch 31, and the condition is maintained.

Figure 14:
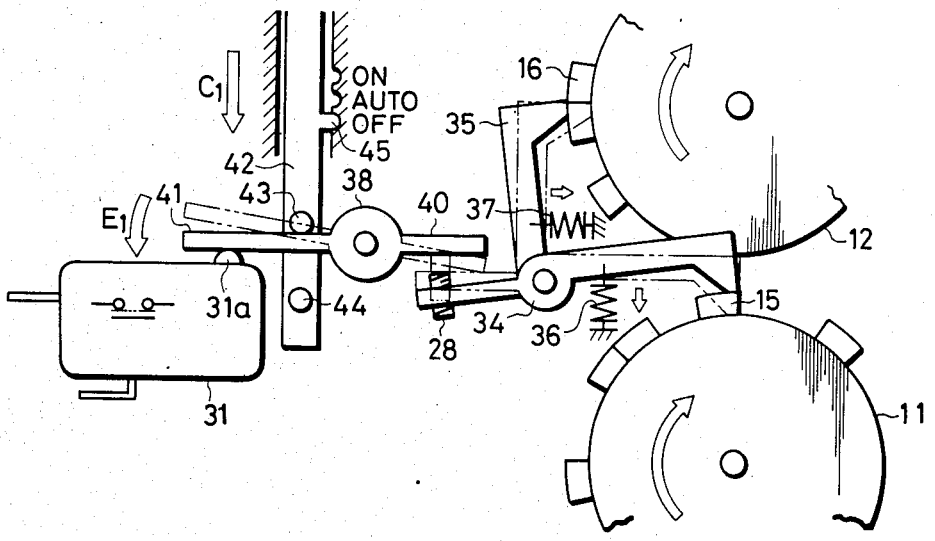

FIG. 14 shows the manual lever 42 shifted to the OFF position to cause an unpowered interruption. Namely, if the manual lever 42 is moved from the AUTO position as shown in FIGS. 11–13 to the OFF position as shown in FIG. 14, the switch 31 is held open regardless of the switching program on the two scale disks 13 and 14. Furthermore, such condition is held even after the change of day unless the manual lever 42 is removed from the OFF position.

The operation is as follows. If the manual lever 42 is depressed, as shown in FIG. 14, in the downward direction of arrow C1, the upper projection 43 presses down the second lever portion 41 of the intermediate lever 38 so that it is necessarily moved in the direction of arrow E1. In this condition, the plunger 31*a* is depressed to thereby open the switch 31 and to maintain such condition, even if both switching levers 34 and 35 are moved.

This means that the so accomplished open condition of the switch 31 is maintained regardless of whether the week switching lever 11 contacts the setter 16 of the week scale disk 12. The open condition set by the manual lever 42 before the change of day is maintained after the change of day. This condition is achieved by the effective combination of the switching levers 34 and 35 and the intermediate lever 38.

Figure 15:
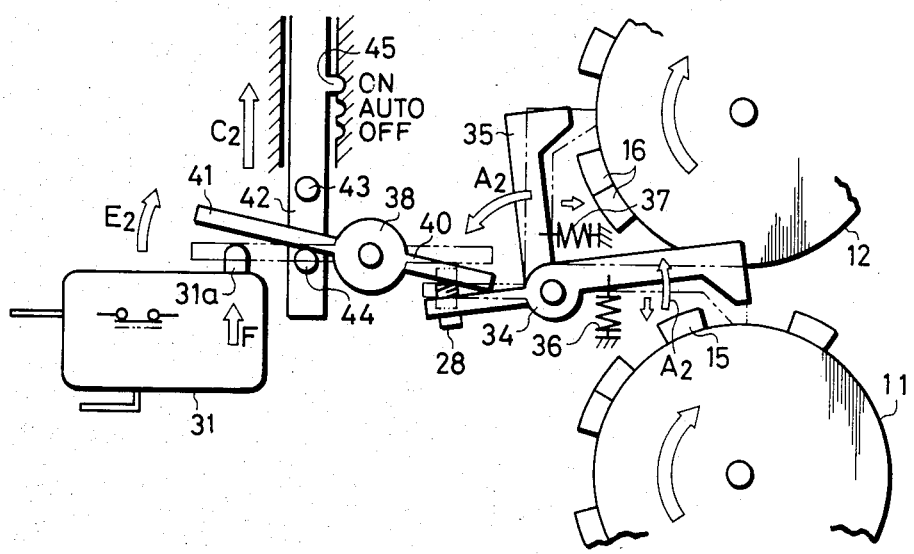

On the other hand, FIG. 15 shows the condition in which the manual lever 42 is set in the ON position to cause a powered interruption. To assume the ON position, the manual lever 42 is moved upward in the direction of C2, so that the lower projection 44 of the manual lever 42 pushes up the intermediate lever 38 in the direction of the arrow E2 thereby freeing the plunger 31*a* to return to its normally ON position under the internal spring return force in the direction of F. As a result, the switch 31 is held in its closed condition. In this condition, although both switching levers 34 and 35 are moved in the counterclockwise direction of arrow A2 by the setters 15 and 16, the switching levers 34 and 35 do not act effectively to control the intermediate lever 38 or the switch 31. This means not only that the switch 31 is maintained in the closed condition regardless of the switching program, but also that the interrupting operation ON conditon is held even after the change of day.

The setters 15 are mounted at corresponding positions on the 24 hour scale disk 11 to indicate when the load 7 (FIG. 1) is to be powered, and are not mounted to indicate when the load 7 is to be unpowered. Similarly, the setters 16 are mounted on the position corresponding to day of the week on the week scale disk 12 to indicate the days when one desires the execution of the program set on the 24 hour scale disk 1 (assuming that the manual lever 42 is set to its AUTO position). The setters 16 are put at positions corresponding to days in which the 24 hour program is to be cancelled.

The embodiment of FIGS. 10–15 have the same effects and advantages as the previously described embodiments.

Figure 16:
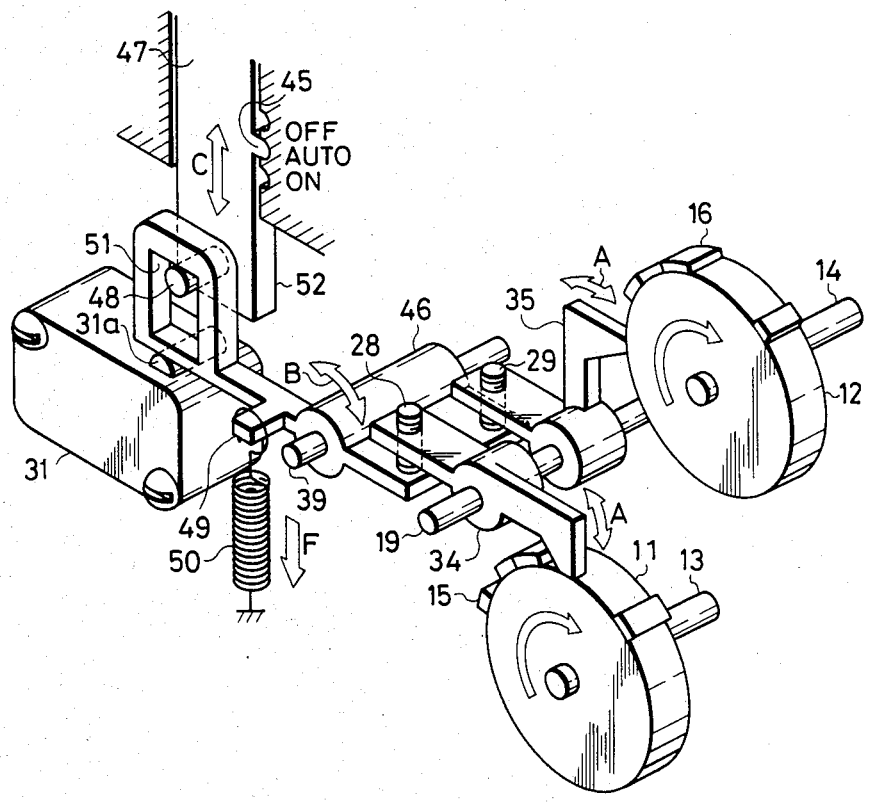
FIG. 16 is a perspective view of a fourth embodiment.

A fourth embodiment of the invention is shown in perspective view in FIG. 16. This embodiment is very similar to the embodiment of FIG. 10 so that like numbered elements will be described only briefly. The two scale disks 11 and 12 and the normally open switch 31 are identical in structure to the corresponding elements in the embodiment of FIG. 10. The switching levers 34 and 35 have an identical structure except that the adjusting screws 28 and 29 contact a modified intermediate lever 46 from above, that is, the switching levers 34 and 35 forcefully rotate the intermediate lever 46 in a clockwise rather than a counter-clockwise direction. A modified slidably manual lever 47 has the position projection 45 and a single side projection 48. The intermediate lever 46 includes a hanging portion 49 which is connected to the support by a tension spring 50 so as to bias the intermediate lever 46 against the plunger 31*a*. The tensile force of the spring 50 is large enough to overcome the spring return force of the plunger 31*a* so that the spring 50, when unopposed, depresses the plunger 31*a* to open the switch 31. The intermediate lever 46 also includes an arch portion 51 through which the side projection 48 projects so as to be confined below the arch portion 51. A bottom 52 of the manual lever 47 is sufficiently low that it depresses the plunger 31*a* when the position projection 45 engages the ON indentation.

Figure 17:
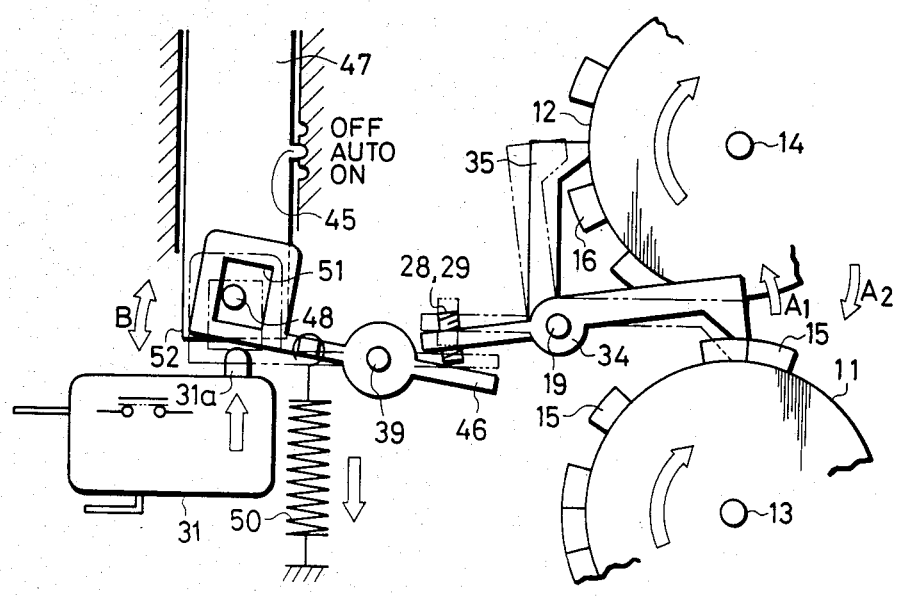
FIGS. 17–20 are side views illustrating the operation of the embodiment of FIG. 16.

The operation of the apparatus in the AUTO mode is explained with reference to FIG. 17. The manual lever 47 is manually slid so that its position projection 45 engages the AUTO indentation. In this position, the side projection 48 is free of the arch portion 51 of the intermediate lever 46. As a result, the intermediate lever 46 is controlled by the positions of the setters 15 and 16 on the two scale discs 11 and 12. However, contrary to the situation with the embodiment of FIG. 10, the presence of the setters 15 and 16 indicates that the load 7 is to be unpowered and the absence of the setters 15 and 16 indicate that the load 7 is to be powered.

When the 24 hour switching lever 34 engages one of the setters 15 and as the 24 hour scale disk 11 rotates, the switching lever 34 rotates counter-clockwise in the direction of arrow A1. This rotation is transmitted through the adjusting screw 28 to cause the intermediate lever 46 to rotate clockwise against the force of the spring 50. As a result, the left side of the intermediate lever 46 lifts off the plunger 31*a* and the switch 31 returns to its normally open or OFF position. Likewise, when the 24 hour switching lever 34 does not engage the setter 15, as shown by the dotted line in FIG. 17, and presuming that the week switch lever 35 is not engaging the setter 16 on the week scale disk 12, then the intermediate lever 46 is rotated counterclockwise by the spring 50 to depress the plunger 31*a* and close the switch 31, that is, to turn it ON.

Figure 18:
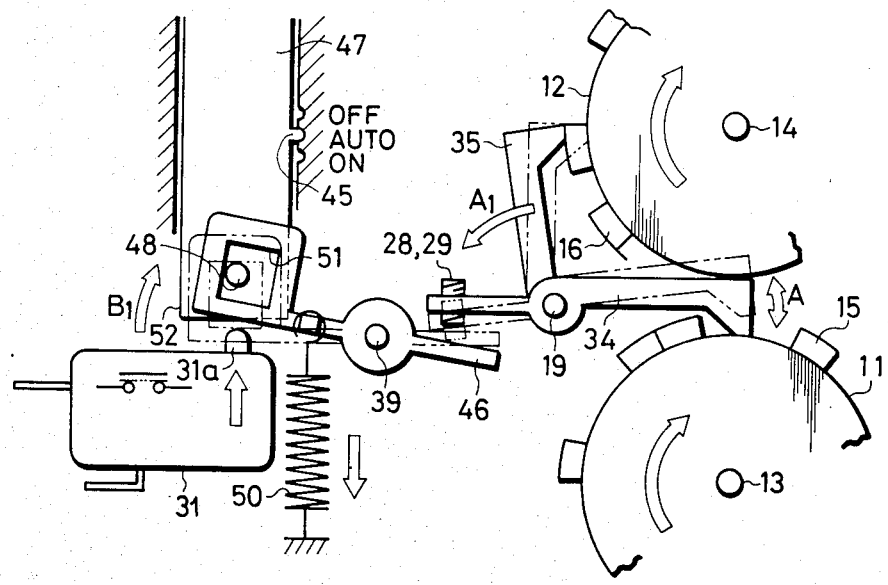

A similar operation is effected by the week scale disk 12, as illustrated in FIG. 18. When the week switching lever 35 is pushed up in the counter-clockwise direction of the arrow A1, its adjusting screw 29 rotates the intermediate lever 46 in the clockwise direction of arrow B1. As a result, the switch 31 is opened or held OFF regardless of the position of the setters 15 on the 24 hour scale disk 11. The effect of the engagement of the week switching lever 35 with the setter 16 is to cancel the switching program of the 24 hour scale disk 11. That is, the 24 hour switching lever 34 can move in either direction, as indicated by the double headed arrow A, without any effect on the switch 31.

Therefore, the program of the 24 hour scale disk 11 can be transmitted to the switch 31 except in the case where the week switching lever 35 is engaging the setter 16 on the week scale disk 12. However, if it is desired that the 24 hour program be cancelled for any day of the week, such as on weekends, the week switching lever 35 is made to engage a positioned setter 16 on the week scale disk 12 which necessarily causes the switch 31 to open regardless of the setting on the 24 hour scale disk 11.

Figure 19:
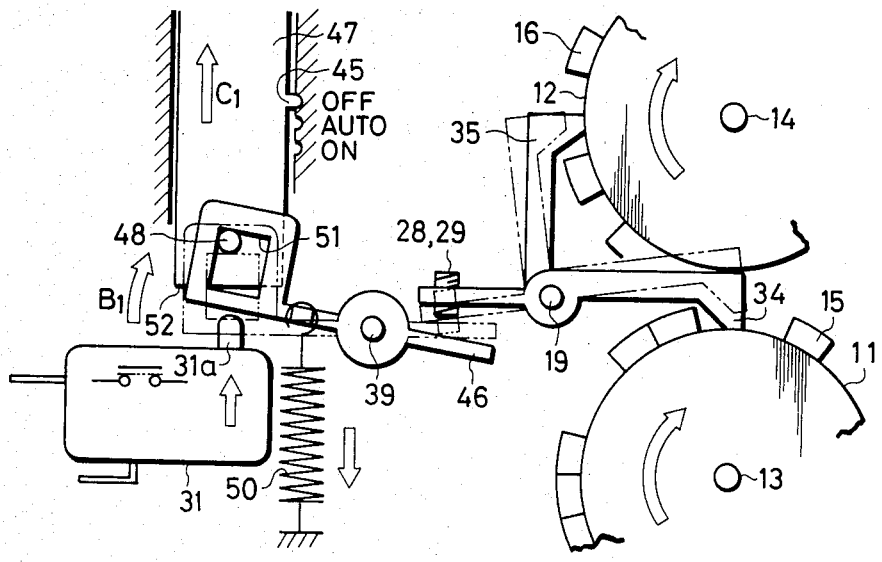

The scale disks 11 and 12 can be overridden by the manual lever 47. If, as shown in FIG. 19, the manual lever 47 is manually slid upwards in the direction of the arrow C1, perhaps against the force of the spring 50 so that its position projection 45 engages the OFF indentation, then the side projection 48 of the lever 47 pulls up the arch portion 51 of the intermediate lever 46. That is, the intermediate lever 46 is rotated clockwise in the direction of the arrow B1. As a result, the intermediate lever 46 is necessarily detached from the plunger 31*a* and the switch 31 is open or held OFF. This OFF position is held regardless of the operation of the switching levers 34 and 35. Therefore, even if both the scale disks 11 and 12 indicate that the switch 31 should be on, nonetheless, the operation is not transmitted to the plunger 31*a* because the manual lever 47 is holding the intermediate lever 46 away from the plunger 31*a*. This means that if the manual lever 47 is moved to the OFF position for the purpose of opening the switch 31 in a temporary manual operation midway through the execution of the scale disk program, the switch 31 remains open regardless of the contents of the program. Furthermore, the condition is held regardless of the rotation of the scale disks 11 and 12, especially at the change of a day.

Figure 20:
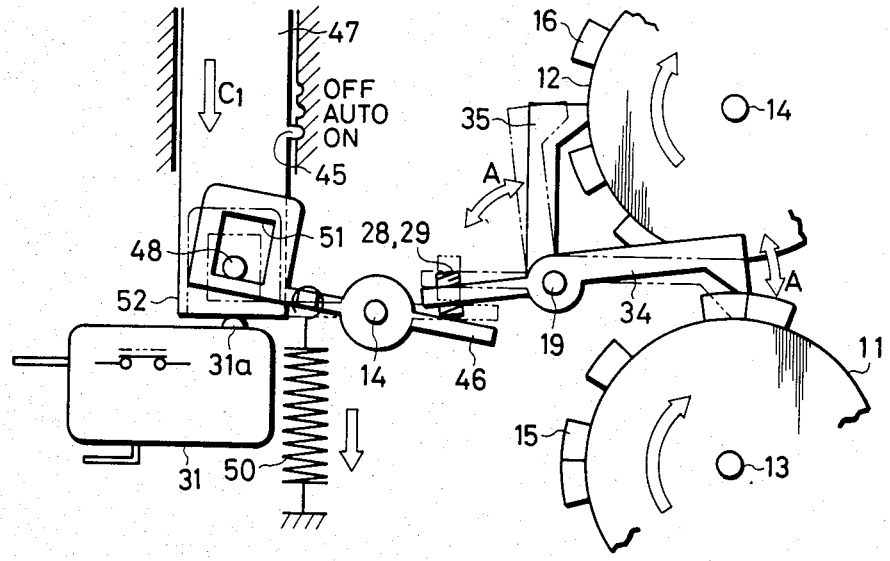

The manual lever 47 can also positively turn on the switch 31. As illustrated in FIG. 20, when the manual lever 47 is pressed down in the direction of the arrow C1 so that its position projection 45 engages the ON indentation, then the bottom 52 of the manual lever 47 pushes the plunger 31*a* to close the contacts of the switch 31. The side projection 48 of the manual lever 47 is located at a position such that the projection 48 does not interfere with the arch portion 51 of the intermediate lever 46 regardless of its position determined by the setters 15 and 16.

Therefore, since the plunger 31*a* is already pushed by the manual lever 47, the switch 31 is not affected by the setter 15 and 16 pushing on the switching levers 34 and 35. For instance, the 24 hour switching lever 34 can move in either direction indicated by the double headed arrow A and the intermediate lever 46 will rotate. However, the plunger 31*a* remains depressed. This means that if the manual lever 47 is pushed into the ON position for the purpose of closing the switch 31 in a temporary manual powered interruption, midway through the execution of the predetermined program, the switch 31 remains closed regardless of the contents of the program and the closed condition is held regardless of the rotation of the scale disk 11 and 12, especially at the end of the day.

As mentioned above, according to the present invention there is provided a switching apparatus for a time switch in which there are provided a selection setting function for automatically selecting for a period the execution or the cancellation of a switching program having a predetermined period shorter than the above period of selection. Furthermore, the invention provides an interrupt operation by which the selected condition can be changed temporarily to a different condition. The interrupting operation effected before the change of day is maintained even after the change of day. Finally, the number of the switching elements are reduced to only one in comparison with the conventional apparatus requiring a plurality of the switching elements, the fabrication and adjustment are easily accomplished, the cost of the fabrication is reduced and the switching capacity is not reduced.

I claim:

1. A switching apparatus, comprising:

a plurality of scale disks rotating with different periods;

setting means disposed on circumferential portions of said disks for defining switching timing;

a plurality of lever means, rotatable independently from each other, for rotating with respect to said setting means;

a lever connected to at least one of said lever means at at least one time point within any given time interval and rotatable in a first direction by the rotation in a second direction opposite said first direction, of any one of said lever means;

a switch actuated by the position of said lever; and mechanical defeating means for preventing the rotation of said lever in any direction regardless of the rotations of said lever means.

2. An apparatus as recited in claim 1, wherein said lever is rotatable in said second direction by the rotation of all said lever means in said first direction.

3. An apparatus as recited in claim 1, further comprising:

a plurality of connecting means in the form of levers connected by springs to each of said lever means and contactable with said lever; and wherein said defeating means comprises means for rotating all said connecting means against said springs.

4. An apparatus as recited in claim 1, wherein said defeating means comprises control means for holding said lever at a fixed position.

5. A switching apparatus, comprising:

a plurality of scale disks to effect one revolution with periods different from each other;

setting members defining a switching timing mounted on said scale disks;

a plurality of switching levers for rotating with respect to said setting members;

a plurality of intermediate levers rotatably and coaxially mounted for being lined with said switching levers respectively;

interlocking means for interlocking said intermediate levers with said plurality of switching levers to rotate said intermediate levers in a predetermined direction when its respective switching lever is pushed radially by said setting member thereby to rotate in said predetermined direction;

a single switch with a plunger for effecting the switching operation by the rotation of said plurality of switching levers;

a manual lever positionable at a first, a second and a third position;

means, operable at said first position, for rotating said plurality of intermediate levers in the direction reverse to said predetermined direction, thereby detaching said plurality of intermediate levers from said plunger;

means, operable at said second position, for rotating said plurality of switching levers in said predetermined direction so that said plurality of intermediate levers is rotated in said predetermined direction thereby to push said plunger; and means, operable at said third position, for detaching said manual lever from both said plurality of switching levers and said plurality of intermediate levers.

6. An apparatus as claimed in claim 5, further comprising means, operable at said first position, for rotating said switching levers in a predetermined direction thereby detaching said switching levers from said setting members.

7. A switching apparatus, comprising:

a plurality of scale disks to effect one revolution with periods different from each other;

a switch having a plunger;

an intermediate lever mounted rotatably around a fixed axis for operating said plunger;

setters on said disks for defining a timing of said switch;

switching levers each of one end portions of which is pushed up by one of said setters to rotate in a predetermined direction, each of the other end portions of which is detached from said intermediate lever;

spring members mounted on each of said levers for providing rotational force to each of said switching levers in a direction reverse to said predetermined direction;

a manual lever moved by a manual operation thereby to be placed in one of three positions;

means, operable at a first position of said manual lever, for depressing said intermediate lever to said plunger;

means, operable at a second position of said manual lever, for detaching said intermediate lever from said plunger; and means, operable at a third position of said manual lever, for detaching said manual lever from said intermediate lever.

8. A switching apparatus, comprising:

a plurality of scale disks to effect one revolution with periods different from each other;

setters mounted on each of said scale disks for defining a switch timing;

an intermediate lever for actuating a plunger of a switch by being rotated around a constant axis;

a switching lever, one end of which is rotated by said setters and the other end of which rotates said intermediate lever in a predetermined direction;

a spring member for rotating said intermediate lever in a direction reverse to said predetermined direction;

a manual lever operated manually and having a first, a second and a third position;

means, operable at said first position, for pushing said plunger of said switch and for detaching said intermediate lever from said plunger;

means, operable at said second position, for detaching said manual lever from said plunger and for detaching said intermediate lever from said plunger by rotating said intermediate lever in said predetermined direction; and means, operable at said third position, for detaching said manual lever from both said plunger and said intermediate lever.

* * * * *